US008851561B2

(12) United States Patent
Huang

(10) Patent No.: US 8,851,561 B2
(45) Date of Patent: Oct. 7, 2014

(54) CONVENIENT TELESCOPIC FOLDING CHAIR

(76) Inventor: Tsung-Chieh Huang, Kaohsiung Hsien (TW)

( * ) Notice: Subject to any disclaimer, the term of this patent is extended or adjusted under 35 U.S.C. 154(b) by 0 days.

(21) Appl. No.: 12/890,726

(22) Filed: Sep. 27, 2010

(65) Prior Publication Data

US 2012/0074737 A1 Mar. 29, 2012

(51) Int. Cl.

| | |
|---|---|
| ***A47C 4/00*** | (2006.01) |
| ***A47C 4/04*** | (2006.01) |
| ***A47C 4/10*** | (2006.01) |
| ***A47C 4/14*** | (2006.01) |
| ***A47C 7/02*** | (2006.01) |

(52) U.S. Cl.
USPC ..... 297/55; 297/23; 297/56; 297/57; 297/440.2; 297/440.21; 297/440.22; 297/440.24

(58) Field of Classification Search
USPC ..... 297/23, 55, 56, 57, 440.2, 440.21, 297/440.22, 440.24
See application file for complete search history.

(56) References Cited

U.S. PATENT DOCUMENTS

| | | | | |
|---|---|---|---|---|
| 6,543,842 | B2 * | 4/2003 | Haney | 297/55 |
| 6,612,654 | B2 * | 9/2003 | Laws et al. | 297/56 X |
| 6,616,223 | B1 * | 9/2003 | Lin | 297/55 |
| 6,695,411 | B2 * | 2/2004 | Leng et al. | 297/440.22 X |
| 6,871,906 | B2 * | 3/2005 | Haney | 297/55 |
| 7,014,261 | B2 * | 3/2006 | Haney | 297/55 |
| 7,017,986 | B2 * | 3/2006 | Degen et al. | 297/58 |
| 7,080,877 | B1 * | 7/2006 | Tsai | 297/23 |
| 7,513,567 | B2 * | 4/2009 | Huang | 297/440.2 X |
| 8,109,564 | B2 * | 2/2012 | Lin et al. | 297/23 |
| 2003/0168893 | A1 * | 9/2003 | Lin | 297/55 |
| 2003/0168894 | A1 * | 9/2003 | Lin | 297/55 |
| 2004/0251718 | A1 * | 12/2004 | Degen et al. | 297/55 |
| 2005/0206202 | A1 * | 9/2005 | Winter et al. | 297/23 |
| 2009/0146467 | A1 * | 6/2009 | Waite et al. | 297/55 |

* cited by examiner

*Primary Examiner* — Rodney B White

(57) ABSTRACT

A convenient telescopic folding chair includes a front foot, back cushion, rear foot, seat cushion, and telescopic rods arranged between the rear foot and the seat cushion. The front foot pivots on the rear foot by connecting components. The back cushion is inserted into two ends of the front foot. The rear foot connects the seat cushion through two telescopic rods arranged to two ends of the rear foot. The seat cushion is further connected to the front foot through connecting components. The seat cushion includes a tube frame and a cushion. The cushion is fixed to the frame will two plugs formed to two lateral sides of the cushion inserting into two ends of the frame so as to form a convenient, space-saving, light and fine folding chair.

1 Claim, 6 Drawing Sheets

CONVENIENT TELESCOPIC FOLDING CHAIR

FIELD OF THE INVENTION

The present invention relates to folding chair, and particular to a convenient telescopic folding chair having telescopic rods and seat cushion formed by a cushion inserted to a tube frame.

DESCRIPTION OF THE PRIOR ART

Folding chairs are very popular in the market. Except the basic folding function, the durability, portability, and storage are also concerned by the user. Prior folding chair mostly consists of seat cushion formed by a wooden-base cushion framed by a closed metal frame. The punched metal seat plate or molded plastic seat plate are also commonly used in folding chairs.

However, the closed metal frame around the cushion will confine the design of the seat of the chair, and the punched metal seat will cause higher cost for manufacturing. The molded plastic seat is concerned about its safety and bearing capability, enhancement of thickness and material will oppositely increase the weight and the waste of storage.

SUMMARY OF THE PRESENT INVENTION

Accordingly, the primary object of the present invention is to provide a convenient, space-saving, light, fine and durable folding chair.

To achieve above object, the present invention includes a front foot, back cushion, rear foot, seat cushion, and telescopic rods arranged between the rear foot and the seat cushion. The front foot pivots on the rear foot by connecting components. The back cushion is inserted into two ends of the front foot. The rear foot connects the seat cushion through two telescopic rods arranged to two ends of the rear foot. The seat cushion is further connected to the front foot through connecting components. The seat cushion includes a tube frame and a cushion. The cushion is fixed to the frame with two plugs formed to two lateral sides thereof inserting into two ends of the frame.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
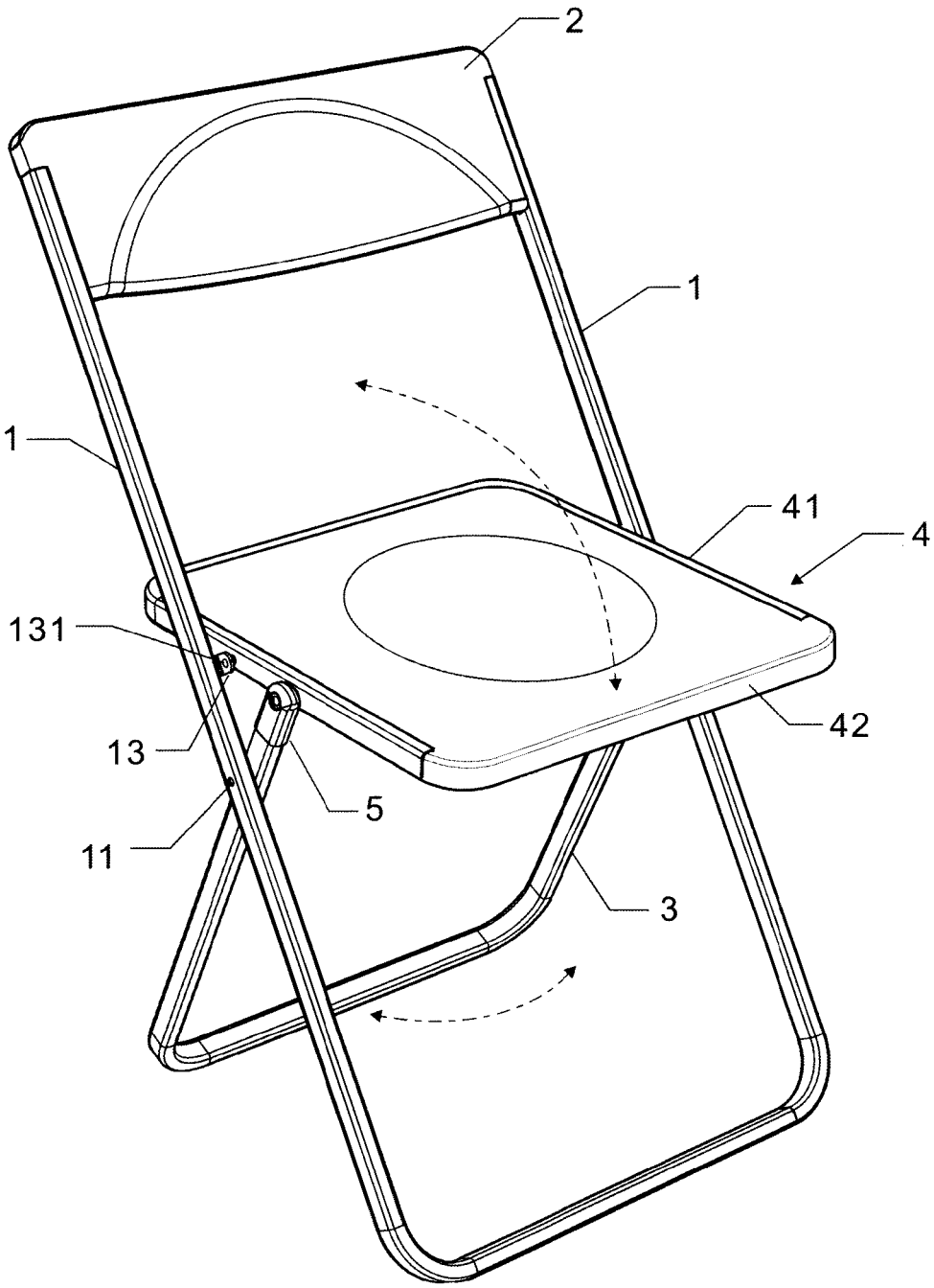
FIG. 1 is a schematic view showing an embodiment of the present invention.
Figure 3:
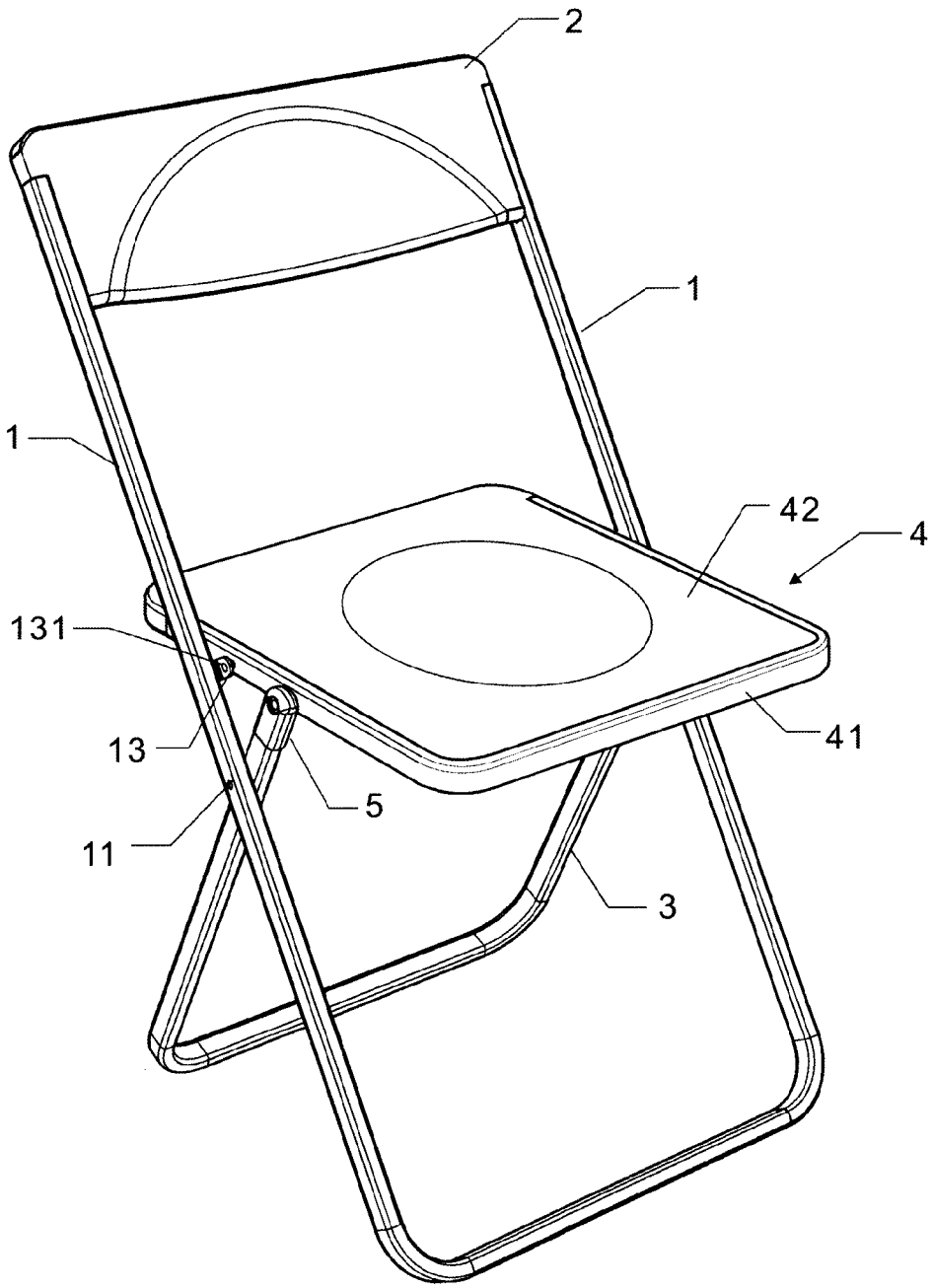
FIG. 3 is a schematic view showing another embodiment of the present invention.

Referring to FIGS. 1 and 3, two embodiments of convenient telescopic folding chair according to the present invention are illustrated. The embodiments both include front foot 1, back cushion 2, rear foot 3, seat cushion 4, and telescopic rods 5 arranged between two lateral sides of the seat cushion 4 and the two ends of the rear foot 3.

Figure 2:
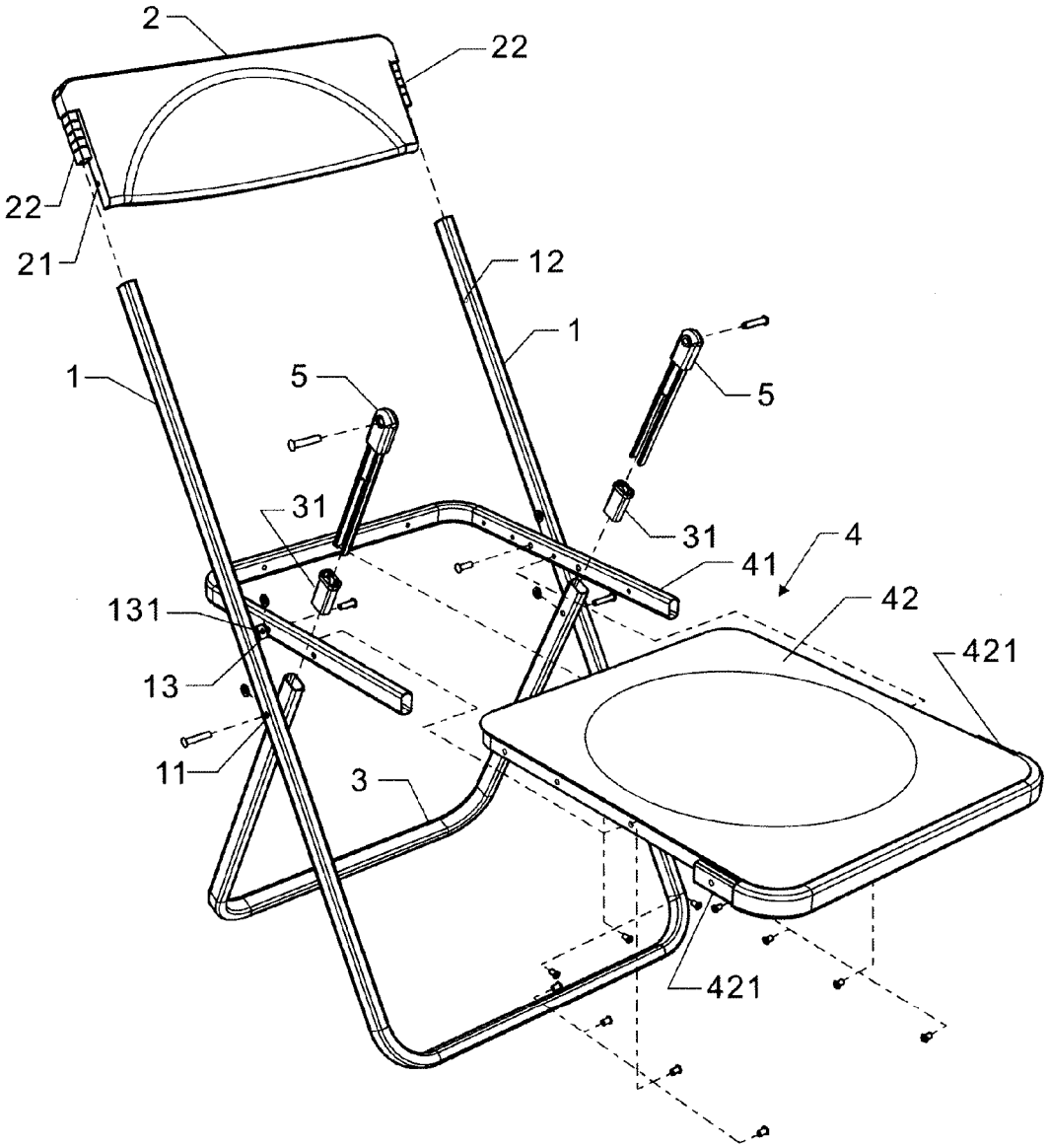
FIG. 2 is an assembling view showing the embodiment in FIG. 1.
Figure 5:
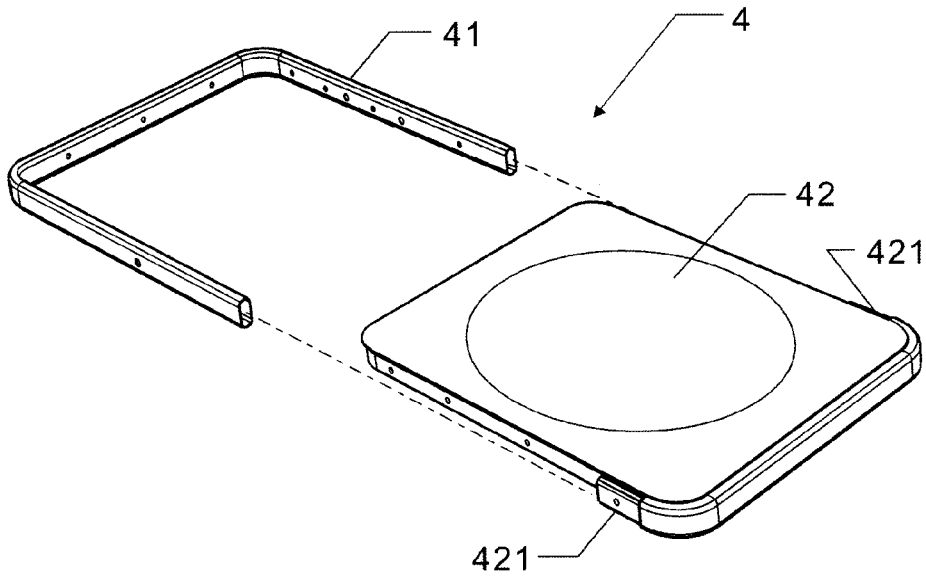
FIG. 5 is an assembling view showing a seat cushion in FIG. 1.

Referring to FIGS. 1, 2, and 5, the front foot 1 pivots on the rear foot 3 through arranging holes 11. Two retaining holes 12 are formed near to two ends of the front foot 1 respectively for receiving two spring-loaded pins 21 on two lateral sides of the back cushion 2. Two plugs 22 are also formed to the two later sides of the back cushion 2 for being inserted into the two ends of the front foot 1 so that the back cushion 2 is fixed to the front foot 1 with the spring-loaded pins 21 being retained by the two retaining holes 12. Two connecting plates 13 are arranged oppositely to predetermined locations of an inner surface of the front foot 1. The connecting plate 13 has a through hole 131 for assembling the front foot 1 to a frame 41 of the seat cushion 4.

Two sleeves 31 are slid into two ends of the rear foot 3 for receiving the two telescopic rods 5. The telescopic rod 5 is fixed to the two lateral sides of the frame 41 of the seat cushion 4. The three connection points of the telescopic rod 5 to the seat cushion 4, the front foot 1 to the seat cushion 4, and the front foot 1 to the rear foot 3 form a triangle so as to provide an ideal support and a strong structure.

Figure 7:
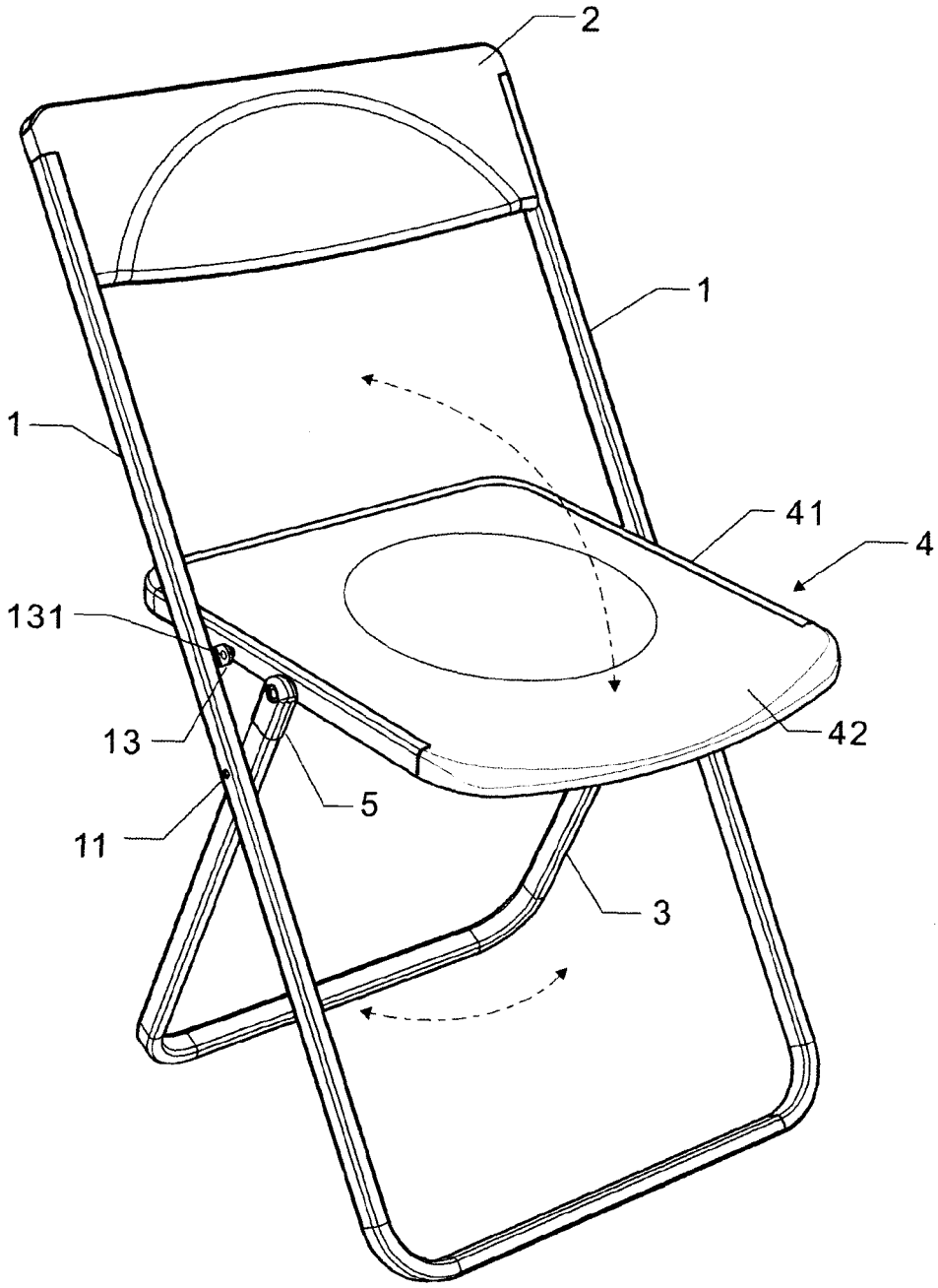
FIG. 7 is a schematic view showing an embodiment of a front edge of the seat cushion of the present invention.

Referring to FIG. 5, the seat cushion 4 includes a tube frame 41 and a cushion 42. A plug 421 is formed to two lateral sides of the cushion 42 respectively for being inserted into the two ends of the frame 41 so as to form the seat cushion 4. The frame 41 sustains a rear and two lateral sides of the cushion 42 so as to provide a high bearing capability based on the supporting of the front and the rear foot. Without the frame 41, the front side of the cushion 42 can be shaped smoothly or ergonomically as shown in FIG. 7.

Figure 4:
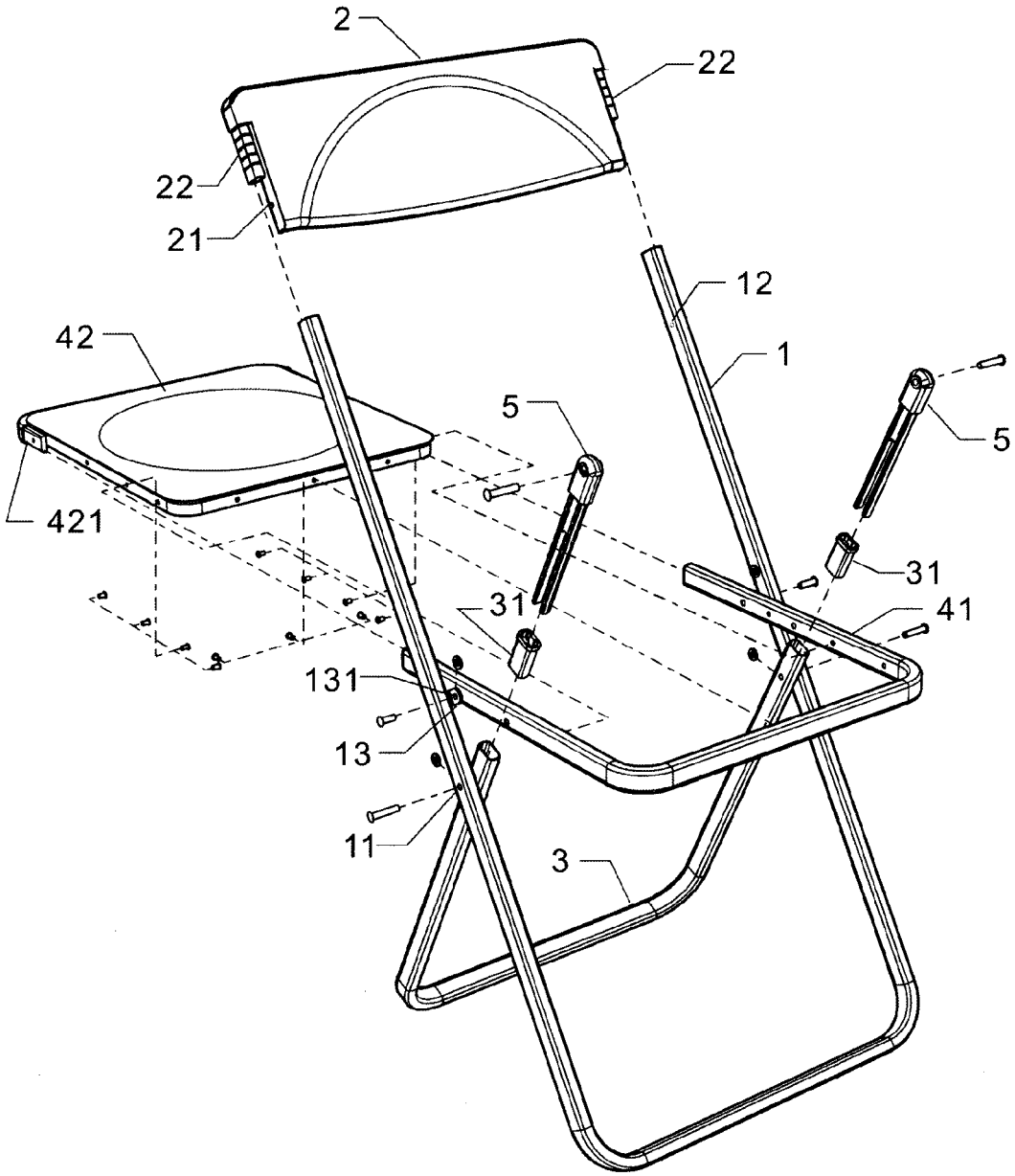
FIG. 4 is an assembling view showing the embodiment in FIG. 3.
Figure 6:
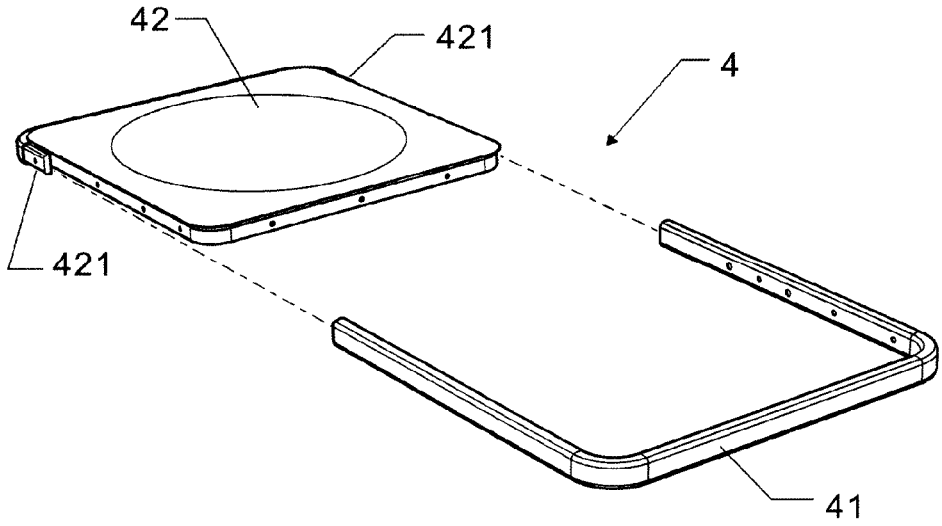
FIG. 6 is an assembling view showing a seat cushion in FIG. 3.

Referring to FIGS. 3, 4, and 6, another embodiment of the present invention is illustrated. The front foot 1 pivots on the rear foot 3 through arranging holes 11. Two retaining holes 12 are formed near to two ends of the front foot 1 for receiving two spring-loaded pins 21 on two lateral sides of the back cushion 2. Two plugs 22 are also formed to the two later sides of the back cushion 2 for being inserted into the two ends of the front foot 1 so that the back cushion 2 is fixed to the front foot 1 with the spring-loaded pins 21 being retained by the two retaining holes 12. Two connecting plates 13 are arranged to predetermined opposite locations of an inner surface of the front foot 1. The connecting plate 13 has a through hole 131 for assembling the front foot 1 to a tube frame 41 of the seat cushion 4.

Two sleeves 31 are slid into two ends of the rear foot 3 for receiving the two telescopic rods 5. The telescopic rod 5 is fixed to the two lateral sides of the frame 41 of the seat cushion 4.

The seat cushion 4 includes the tube frame 41 and a cushion 42 as shown in FIG. 6. A plug 421 is formed to two lateral sides of the cushion 42 respectively for being inserted into the two ends of the frame 41 so as to form the seat cushion 4. The frame 41 sustains a front and the two lateral sides of the cushion 42 so as to provide a high bearing capability based on the supporting of the front and the rear foot.

The present invention is light and space-saving for its thin folded thickness. The ergonomic design will improve the appearance and comfort thereof as well as the quality, practicability, and economic benefit.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A convenient telescopic folding chair, comprising:

a front foot (1), a back cushion (2), a rear foot (3), a seat cushion (4), and two telescopic rods (5) arranged between two lateral sides of the seat cushion (4) and two ends of the rear foot (3);

the front foot (1) pivotally connecting with the rear foot (3); two retaining holes (12) being formed near to two ends of the front foot (1) respectively for receiving two spring-loaded pins (21) on two lateral sides of the back cushion (2); two plugs (22) being formed to the two lateral sides of the back cushion (2) for being inserted into the two ends of the front foot (1) so that the back cushion (2) is fixed to the front foot (1) with the spring-loaded pins (21) being retained by the two retaining holes (12); two connecting plates (13) being arranged oppositely to predetermined locations of an inner surface of the front foot (1); each connecting plate (13) having a through hole (131) for assembling the front foot (1) to a frame (41) of the seat cushion (4);

two sleeves (31) being slid into two ends of the rear foot (3) for receiving the two telescopic rods (5); each telescopic rod (5) being fixed to the two lateral sides of the frame (41) of the seat cushion (4); three connection points of the telescopic rod (5) to the seat cushion (4); the front foot (1) to the seat cushion (4), and the front foot (1) to the rear foot (3) forming a triangle so as to provide an ideal support and a strong structure;

and the seat cushion including a U-shaped tube frame (41) and a cushion (42); a U-shaped plug (421) being formed to cover a front side and two lateral sides of the cushion (42), respectively; and two ends of the plug (321) being inserted into the two ends of the U-shaped tube frame (41) so that the U-shaped tube frame (41) encloses a rear side and the two lateral sides of the cushion (42); and thus the cushion (42) being supported; the U-shaped tube frame (41) sustaining the rear and the two lateral sides of the cushion (42), so as to provide a high bearing capability based on support of the front and the rear foot.

* * * * *